US011097934B2

(12) United States Patent
Tu et al.

(10) Patent No.: US 11,097,934 B2
(45) Date of Patent: Aug. 24, 2021

(54) BOTTLE STRIKING

(71) Applicant: COUP BRANDS IP, LLC, Benicia, CA (US)

(72) Inventors: Ryan Tu, Benicia, CA (US); Dennis Storz, San Francisco, CA (US); Ryan Braunstein, San Carlos, CA (US); Jean Paul Desrochers, Davie, FL (US)

(73) Assignee: Coup Brands IP, LLC, Benicia, CA (US)

( * ) Notice: Subject to any disclaimer, the term of this patent is extended or adjusted under 35 U.S.C. 154(b) by 124 days.

(21) Appl. No.: 16/451,439

(22) Filed: Jun. 25, 2019

(65) Prior Publication Data

US 2019/0367344 A1 Dec. 5, 2019

Related U.S. Application Data

(63) Continuation of application No. 15/395,663, filed on Dec. 30, 2016, now Pat. No. 10,370,232.

(60) Provisional application No. 62/302,746, filed on Mar. 2, 2016.

(51) Int. Cl.

| | |
|---|---|
| ***B67B 7/06*** | (2006.01) |
| ***B65D 55/16*** | (2006.01) |
| ***B65D 49/12*** | (2006.01) |
| *B67B 7/92* | (2006.01) |

(52) U.S. Cl.

CPC ..... *B67B 7/066* (2013.01); *B65D 49/12* (2013.01); *B65D 55/16* (2013.01); *B67B 7/92* (2013.01)

(58) Field of Classification Search

CPC ..... B65D 49/12; B65D 55/16; B67B 7/066

See application file for complete search history.

(56) References Cited

U.S. PATENT DOCUMENTS

| | | | |
|---|---|---|---|
| 5,016,499 | A | 5/1991 | Saveland |
| 5,405,033 | A | 4/1995 | Sweed |
| 5,845,994 | A | 12/1998 | Rice |

(Continued)

FOREIGN PATENT DOCUMENTS

| | | |
|---|---|---|
| DE | 4119804 | 12/1992 |
| EP | 0934902 | 8/1999 |

(Continued)

OTHER PUBLICATIONS

English translation of DE-4119804-A1. (Year: 1992).*

(Continued)

*Primary Examiner* — Jennifer S Matthews

(74) *Attorney, Agent, or Firm* — Fish & Richardson P.C.

(57) ABSTRACT

A bottle assembly includes: a pressurized bottle of fluid having an elongated body and a neck extending contiguously from the body to a top portion including an outwardly projecting annular flange; and a bottle severing mechanism including a bottle striker carried by the bottle and residing below the top portion. The bottle striker includes: a frame mounted to move relative to the bottle in response to an impact by a saber while remaining coupled to the bottle; and a striking edge extending from the frame and aligned with a lower surface of the annular flange of the bottle, such that movement of the frame relative to the bottle causes the striking edge to strike the lower surface of the annular flange to sever the top portion of the bottle from the body.

17 Claims, 10 Drawing Sheets

(56) References Cited

U.S. PATENT DOCUMENTS

| | | | | |
|---|---|---|---|---|
| 6,062,107 | A * | 5/2000 | Johnson | B67B 7/066 81/3.36 |
| 6,095,352 | A | 8/2000 | Lambert | |
| 7,344,308 | B2 | 3/2008 | Meyer | |
| 10,370,232 | B2 | 8/2019 | Tu et al. | |
| 2006/0225536 | A1 | 10/2006 | Hill | |
| 2011/0031208 | A1 | 2/2011 | Golden | |
| 2015/0368083 | A1 | 12/2015 | Tu et al. | |
| 2017/0253361 | A1 | 9/2017 | Tu et al. | |

FOREIGN PATENT DOCUMENTS

| | | | | |
|---|---|---|---|---|
| FR | 2912394 | | 8/2008 | |
| GB | 443105 | | 2/1936 | |
| GN | 103803466 | A | 5/2014 | |
| GN | 105314575 | A | 2/2016 | |
| WO | WO-9210409 | A1 * | 6/1992 | B65D 55/16 |

OTHER PUBLICATIONS

International Search Report and Written Opinion for International Application No. PCT/US2017/020210, dated May 22, 2017, 13 pages.

CN Office Action in Chinese Appln. No. 201780027172.X, dated Dec. 18, 2019, 16 pages (with English translation).

EPO Extended European Search Report in Appln. No. 17760722.3, dated Oct. 10, 2019, 8 pages.

* cited by examiner

BOTTLE STRIKING

CROSS-REFERENCE TO RELATED APPLICATIONS

This application is a continuation of U.S. patent application Ser. No. 15/395,663, entitled "Bottle Striking," filed Dec. 30, 2016, which is incorporated herein by reference in its entirety.

TECHNICAL FIELD

This specification generally relates to apparatus, assemblies and methods for striking a pressurized bottle of fluid with a sabering strike, so as to sever a top portion of the bottle.

BACKGROUND

Bottle sabering, also known as "sabrage," is a ceremonial technique for opening a pressurized glass bottle, such as a sparkling wine or champagne bottle, by severing its top with a solid object—typically a saber. Conventionally, sabrage involves sliding the saber rapidly along a seam of the bottle until it strikes the lower surface of an annular flange at the top portion of the bottle. The intersection of the seam and the annular flange creates a stress concentration that significantly decreases the strength of the glass bottle. The impact of the saber's edge at the bottle's weak point creates a rapidly expanding crack that severs the top from the bottle. With the bottle top removed, the contents of the bottle can be freely poured.

Sabrage is increasingly a unique addition to many gatherings and celebrations. When performed correctly, the technique is dramatic and impressive to spectators. However, when not performed precisely, there is a serious risk of shattering the bottle entirely. Thus, apparatus and methods are sought to perform sabrage safely and reliably.

SUMMARY

In a first aspect, a bottle assembly includes: a pressurized bottle of fluid including an elongated body, a neck extending contiguously from the body to a top opening; a closure member received by the top opening of the bottle; and a bottle severing mechanism including an articulated linkage for constraining movement of a top portion of the bottle that has been severed by a sabering strike. The linkage includes a lever member pivotally coupled to the bottle below the top opening; and a retainer member having a first end directly attached to the closure member and a second end attached to the lever member by a hinge joint remote from both the bottle and the closure member.

In a second aspect, a method of opening a pressurized bottle of fluid includes holding a bottle assembly in a substantially fixed position. The bottle assembly includes: a pressurized bottle of fluid including an elongated body, a neck extending contiguously from the body to a top opening; a closure member received by the top opening of the bottle; and a bottle severing mechanism including an articulated linkage. The linkage includes a lever member pivotally coupled to the bottle below the top opening; and a retainer member having a first end directly attached to the closure member and a second end attached to the lever member by a hinge joint remote from both the bottle and the closure member. The method further includes impacting a portion of the bottle assembly with a saber with sufficient force to sever a top portion of the bottle from the body; and constraining, with the articulated linkage, movement of the severed top portion of the bottle to the rotational pitch direction, such that movement in the rotational roll and yaw directions is inhibited.

In some examples of the first or second aspect, a pivotal coupling securing the lever member to the bottle includes a uniaxial connection permitting rotational movement in only one degree of freedom. In some examples, the hinge joint includes a uniaxial connection between the lever and retainer members permitting relative rotational movement in only one degree of freedom. In some examples, the rotational movement permitted by the pivotal coupling and the hinge joint is in the same rotational direction, such that the linkage permits movement of the severed top portion with multiple degrees of freedom in only a single plane.

In some examples of the first or second aspect, the lever member and the retainer member are posed at an acute angle relative to one another.

In some examples of the first or second aspect, the hinge joint includes a uniaxial connection between the lever and retainer members permitting relative rotational movement in rotational pitch direction, while preventing relative rotational roll and yaw movement. In some examples, the hinge joint prevents relative translating movement between the lever and the retainer members.

In some examples of the first or second aspect, upon severing of the top portion of the bottle, the linkage includes a free-end, two-bar linkage having two degrees of freedom.

In some examples of the first or second aspect, the bottle severing mechanism further includes a bottle striker carried by the bottle and residing below the top portion of the bottle. In some examples, the bottle striker includes: a frame mounted to move relative to the bottle in response to the sabering strike while remaining coupled to the bottle; and a striking edge extending from the frame and aligned with a lower surface of an annular flange of the bottle, such that movement of the frame relative to the bottle causes the striking edge to strike a lower surface of the annular flange to sever the top portion of the bottle from the body. In some examples, the frame is seated on a guide member extending radially outward from the bottle, and configured to ride along the guide member, such that movement of the frame induced by the sabering strike is guided in an upward direction relative to the annular flange. In some examples, the bottle striker further includes a base plate held fixed against a lower surface of the frame, and the guide member is encased within interior cavities of the frame and base plate.

In some examples of the first or second aspect, the bottle assembly further includes a muselet for retaining the closure member in place relative to the bottle, the muselet at least partially covering a portion of the closure member and extending no further than a region of the bottle between the top opening and an annular flange proximate the neck of the bottle, such that a lower surface of the annular flange remains exposed for impact triggered by the sabering strike.

In some examples of the first or second aspect, the bottle assembly further includes a retention member coupled to the bottle and extending over the closure and top opening of the bottle prior to the sabering strike. In some examples, the retention member includes a flexible mesh attached to the neck of the bottle. In some examples, the retention member further includes a safety mechanism including a key ring configured to receive a portion of the user's hand while gripping the bottle during the sabering strike.

In some examples of the first or second aspect, the bottle assembly further includes a pour spout releasably coupled to the bottle and covering an exposed portion of the neck following the sabering strike, the pour spout configured to facilitate the controlled dispensing of fluid contained in the bottle. In some examples, the pour spout includes a hollow body defining a central bore, and a filter residing in the bore, the filter configured to inhibit the dispensing of non-fluid particles from the bottle assembly. In some examples, the pour spout is directly attachable to a portion of the bottle severing mechanism.

In a third aspect, a bottle assembly includes: a pressurized bottle of fluid including an elongated body, a neck extending contiguously from the body to a top opening receiving a closure member; and a bottle severing mechanism including an articulated linkage including a pair of linkage members coupled by a hinge joint remote from both the bottle and the closure member, the linkage configured to facilitate rotational pitch movement of a top portion of the bottle relative to the body, while preventing rotational roll and yaw movement of the top portion, when the top portion is severed from the body by a sabering strike.

In some examples of the third aspect, the linkage members include: a lever member coupled to the bottle below the top opening; and a retainer member having a first end directly attached to the closure member and a second end attached to the lever member by a the hinge joint.

In some examples of the third aspect, the bottle assembly further includes a pivotal coupling securing a first of the linkage members to the bottle, and including a uniaxial connection permitting rotational movement in only that rotational pitch direction.

In some examples of the third aspect, the hinge joint includes a uniaxial connection between respective portions of the linkage members permitting relative movement in only the rotational pitch direction. In some examples, the hinge joint prevents relative translating movement between the linkage members.

In some examples of the third aspect, the linkage members are posed at an acute angle relative to one another.

In some examples of the third aspect, upon severing the top portion of the bottle, the linkage includes a free-end, two-bar linkage having two degrees of freedom.

In some examples of the third aspect, the bottle severing mechanism further includes a bottle striker carried by the bottle and residing below the top portion of the bottle. In some examples, the bottle striker includes: a frame mounted to move relative to the bottle in response to the sabering strike while remaining coupled to the bottle; and a striking edge extending from the frame and aligned with a lower surface of an annular flange of the bottle, such that movement of the frame relative to the bottle causes the striking edge to strike a lower surface of the annular flange to sever the top portion of the bottle from the body. In some examples, the frame is seated on a guide member extending radially outward from the bottle, and configured to ride along the guide member, such that movement of the frame induced by the sabering strike is guided in an upward direction relative to the annular flange. In some examples, the bottle striker further includes a base plate held fixed against a lower surface of the frame, and the guide member is encased within interior cavities of the frame and base plate.

In some examples of the third aspect, the bottle assembly further includes a muselet for retaining the closure member in place relative to the bottle, the muselet at least partially covering a portion of the closure member and extending no further than a region of the bottle between the top opening and an annular flange proximate the neck of the bottle, such that a lower surface of the annular flange remains exposed for impact triggered by the sabering strike.

In some examples of the third aspect, the bottle assembly further includes a retention member coupled to the bottle and extending over the closure and top opening of the bottle prior to the sabering strike. In some examples, the retention member includes a flexible mesh attached to the neck of the bottle. In some examples, the retention member further includes a safety mechanism including a key ring configured to receive a portion of the user's hand while gripping the bottle during the sabering strike.

In some examples of the third aspect, the bottle assembly further includes a pour spout releasably coupled to the bottle and covering an exposed portion of the neck following the sabering strike, the pour spout configured to facilitate the controlled dispensing of fluid contained in the bottle. In some examples, the pour spout includes a hollow body defining a central bore, and a filter residing in the bore, the filter configured to inhibit the dispensing of non-fluid particles from the bottle assembly. In some examples, the pour spout is directly attachable to a portion of the bottle severing mechanism.

In a fourth aspect, a bottle assembly includes: a pressurized bottle of fluid having an elongated body and a neck extending contiguously from the body to a top portion including an outwardly projecting annular flange; and a bottle severing mechanism including a bottle striker carried by the bottle and residing below the top portion. The bottle striker includes: a frame mounted to move relative to the bottle in response to an impact by a saber while remaining coupled to the bottle; and a striking edge extending from the frame and aligned with a lower surface of the annular flange of the bottle, such that movement of the frame relative to the bottle causes the striking edge to strike the lower surface of the annular flange to sever the top portion of the bottle from the body.

In a fifth aspect, a method of opening a pressurized bottle of fluid includes holding a bottle assembly in a substantially fixed position. The bottle assembly includes: a pressurized bottle of fluid having an elongated body and a neck extending contiguously from the body to a top portion including an outwardly projecting annular flange; and a bottle severing mechanism including a bottle striker carried by the bottle and residing below the top portion. The bottle striker includes: a frame mounted to move relative to the bottle while remaining coupled to the bottle; and a striking edge extending from the frame and aligned with a lower surface of the annular flange of the bottle. The method further includes impacting a portion of the bottle assembly with a saber with sufficient force to move the frame relative to the bottle and cause the striking edge to strike the lower surface of the annular flange to sever the top portion of the bottle from the body.

In some examples of the fourth or fifth aspect, the frame includes an arcuate structure having a convex front face and a concave rear face cooperating with a curve of the bottle.

In some examples of the fourth or fifth aspect, the frame is seated on a guide member extending radially outward from the bottle. In some examples, the guide member includes a T-nut. In some examples, the guide member is carried by a collar fitted around an outer surface of the neck. In some examples, the frame is configured to ride along the guide member, such that movement of the frame induced by the impact of the saber is guided in an upward direction relative to the annular flange. In some examples, the frame includes: an interior slot configured to receive the guide member; and an upper shelf closing a top end of the slot, the shelf abutting a top surface of the guide member. In some examples, the bottle striker further includes a base plate held fixed against a lower surface of the frame, the base plate including a recess configured to receive the guide member, and the guide member is encased by the slot of the frame and the recess of the base plate. In some examples, movement of the frame relative to the bottle is limited by the depth of the recess.

In some examples of the fourth or fifth aspect, the striking edge is aligned with a seam of the bottle, such that a point of impact with the lower surface of the annular flange includes a structural weak point where the seam intersects with the annular flange.

In some examples of the fourth or fifth aspect, the striking edge has an upwardly sloping profile, narrowing to a straight-edge tip at its peak.

In some examples of the fourth or fifth aspect, the bottle severing mechanism further includes an articulated linkage for constraining movement of the top portion of the bottle. In some examples, the linkage includes at least two linkage members coupled by a hinge joint remote from both the bottle and a closure member received by a top opening of the bottle, the linkage configured to facilitate rotational pitch movement of the severed top portion of the bottle relative to the body, while preventing rotational roll and yaw movement of the top portion. In some examples, the linkage includes: a lever member pivotally coupled to the bottle; and a retainer member having a first end directly attached to a closure member received by a top opening of the bottle, and a second end attached to the lever member by a hinge joint. In some examples, the hinge joint includes a uniaxial connection between the lever and retainer members permitting relative rotational movement in only one degree of freedom. In some examples, the linkage permits rotational movement of the severed top portion with multiple degrees of freedom in only a single plane.

In some examples of the fourth or fifth aspect, the bottle assembly further includes a muselet for retaining a closure member residing in a top opening of the bottle, the muselet at least partially covering a portion of the closure member and extending no further than a region of the bottle between the top opening and an annular flange proximate the neck of the bottle, such that a lower surface of the annular flange remains exposed for impact by the striking edge.

In some examples of the fourth or fifth aspect, the bottle assembly further includes a retention member coupled to the bottle and extending over the closure and top opening of the bottle prior to the sabering strike. In some examples, the retention member includes a flexible mesh attached to the neck of the bottle. In some examples, the retention member further includes a safety mechanism including a key ring configured to receive a portion of the user's hand while gripping the bottle during the sabering strike.

In some examples of the fourth or fifth aspect, the bottle assembly further includes a pour spout releasably coupled to the bottle and covering an exposed portion of the neck following the sabering strike, the pour spout configured to facilitate the controlled dispensing of fluid contained in the bottle. In some examples, the pour spout includes a hollow body defining a central bore, and a filter residing in the bore, the filter configured to inhibit the dispensing of non-fluid particles from the bottle assembly. In some examples, the pour spout is directly attachable to a portion of the bottle severing mechanism.

In a sixth aspect, a bottle assembly includes: a bottle containing a pressured fluid within an interior cavity, the bottle having an elongated body, and a neck extending contiguously from the body to a top portion of the bottle including an outwardly projecting annular flange and a top opening above the flange; a closure member including a first portion received within the interior cavity of the bottle by the top opening to seal the bottle, and a second portion extending integrally from the first portion to reside beyond the interior cavity and above the top opening; and a muselet for retaining the closure member in place relative to the bottle, the muselet at least partially covering the second portion of the closure member. The muselet extends only to a region of the bottle between the top opening and the annular flange, such that a lower surface of the annular flange remains exposed for sabering the top portion of the bottle from the body without striking the muselet.

In some examples of the sixth aspect, the closure member includes a cork.

In some examples of the sixth aspect, the muselet includes: a lattice structure draped over the second portion of the closure member; and a band fitted over the lattice structure and tightened against the surface of the bottle in the region between the top opening and the annular flange. In some examples, the lattice structure includes a flexible fishnet material. In some examples of the sixth aspect, the bottle assembly further includes a bottle severing mechanism including a bottle striker carried by the bottle and residing below the top portion of the bottle. In some examples, the bottle striker includes: a frame mounted to move relative to the bottle in response to a sabering strike while remaining coupled to the bottle; and a striking edge extending from the frame and aligned with the lower surface of the annular flange, such that movement of the frame relative to the bottle causes the striking edge to strike a lower surface of the annular flange to sever the top portion of the bottle from the body. In some examples, the frame is seated on a guide member extending radially outward from the bottle, and configured to ride along the guide member, such that movement of the frame induced by the sabering strike is guided in an upward direction relative to the annular flange. In some examples, the bottle striker further includes a base plate held fixed against a lower surface of the frame, and the guide member is encased within interior cavities of the frame and base plate.

In some examples of the sixth aspect, the bottle assembly further includes a bottle severing mechanism including an articulated linkage for constraining movement of the top portion of the bottle after the top portion has been severed by a sabering strike. In some examples, the linkage includes at least two linkage members coupled by a hinge joint remote from both the bottle and the closure member, the linkage configured to facilitate rotational pitch movement of the severed top portion of the bottle relative to the body, while preventing rotational roll and yaw movement of the top portion. In some examples, the linkage includes: a lever member pivotally coupled to the bottle; and a retainer member having a first end directly attached to the closure member and a second end attached to the lever member by a hinge joint remote from both the bottle and the closure member. In some examples, the hinge joint includes a uniaxial connection between the lever and retainer members permitting relative rotational movement in only one degree of freedom. In some examples, the linkage permits rotational movement of the severed top portion with multiple degrees of freedom in only a single plane.

In some examples of the sixth aspect, the bottle assembly further includes a retention member coupled to the bottle and extending over the closure and top opening of the bottle prior to the sabering strike. In some examples, the retention member includes a flexible mesh attached to the neck of the bottle. In some examples, the retention member further includes a safety mechanism including a key ring configured to receive a portion of the user's hand while gripping the bottle during the sabering strike.

In some examples of the sixth aspect, the bottle assembly further includes a pour spout releasably coupled to the bottle and covering an exposed portion of the neck following the sabering strike, the pour spout configured to facilitate the controlled dispensing of fluid contained in the bottle. In some examples, the pour spout includes a hollow body defining a central bore, and a filter residing in the bore, the filter configured to inhibit the dispensing of non-fluid particles from the bottle assembly. In some examples, the pour spout is directly attachable to a portion of a bottle severing mechanism.

In a seventh aspect, a bottle assembly includes: a pressurized bottle of fluid having an elongated body and a neck extending contiguously from the body to a top portion including an outwardly projecting annular flange and a top opening above the flange receiving a closure member; and a bottle severing mechanism. The bottle severing mechanism includes a bottle striker carried by the bottle and residing below the top portion and an articulated linkage. The bottle striker is configured to strike a lower surface of the annular flange to sever the top portion of the bottle from the body in response to an impact by a saber. The articulated linkage is configured to facilitate limited rotational pitch movement of the top portion of the bottle relative to the body, while preventing rotational roll and yaw movement of the top portion, when the top portion is severed from the body by the bottle striker.

In an eighth aspect, a method of assembling a bottle assembly includes: aligning a striking edge of a bottle striker with a lower surface of an annular flange of a pressurized bottle of fluid; coupling the bottle striker to the bottle below the annular flange; and constructing an articulated linkage on the bottle for constraining movement of a top portion of the bottle that has been severed by a sabering strike. Constructing the linkage includes: pivotally coupling a lever member of the linkage to the bottle below the annular flange; coupling a retainer member of the linkage to a closure member received by a top opening of the bottle; and attaching the lever member to the retainer member at a hinge joint remote from both the bottle and the closure member.

In a ninth aspect, a bottle assembly includes: a bottle containing a pressured fluid within an interior cavity, the bottle having an elongated body, and a neck extending contiguously from the body to a top portion of the bottle including an outwardly projecting annular flange and a top opening above the flange; a closure member including a first portion received within the interior cavity of the bottle by the top opening to seal the bottle, and a second portion extending integrally from the first portion to reside beyond the interior cavity and above the top opening; a bottle severing mechanism including a bottle striker carried by the bottle and residing below the top portion, the bottle striker configured to strike a lower surface of the annular flange to sever the top portion of the bottle from the body in response to an impact by a saber; and a muselet for retaining the closure member in place relative to the bottle, the muselet at least partially covering the second portion of the closure and extending to a region of the bottle between the top opening and the annular flange, such that a lower surface of the annular flange remains exposed for contact by the bottle striker.

In a tenth aspect, a method of assembling a bottle assembly includes: aligning a striking edge of a bottle striker with a lower surface of an annular flange of a pressurized bottle of fluid; coupling the bottle striker to the bottle below the annular flange; covering at least a portion of a closure member received by a top opening of the bottle with a muselet; positioning an end portion of the muselet in a region of the bottle between the top opening and the annular flange, leaving the lower surface of the annular flange exposed for contact by the striking edge; and securing the positioned end portion of the muselet to the bottle.

In a twelfth aspect, a bottle assembly includes: a pressurized bottle of fluid having an elongated body and a neck extending contiguously from the body to a top portion receiving a closure member; a bottle severing mechanism carried by the bottle and residing below the top portion, the bottle severing mechanism configured to facilitate a sabering strike severing the top portion of the bottle and constrain movement of the severed top portion; and a pour spout releasably coupled to the bottle and covering an exposed portion of the neck following the sabering strike, the pour spout configured to facilitate the controlled dispensing of fluid contained in the bottle.

In a thirteenth aspect, a method of dispensing fluid from a pressurized bottle includes holding a bottle assembly in a substantially fixed position in preparation for a sabering strike. The bottle assembly includes: a pressurized bottle of fluid having an elongated body and a neck extending contiguously from the body to a top portion receiving a closure member; a bottle severing mechanism carried by the bottle and residing below the top portion; and a pour spout releasably coupleable to the bottle. The method further includes: impacting a portion of the bottle severing mechanism with a saber with sufficient force to sever the top portion of the bottle from the body; constraining, with the bottle severing mechanism, movement of the severed top portion of the bottle; and covering an exposed portion of the neck of the bottle following the sabering strike with the pour spout, and controllably dispensing fluid from the bottle through the pour spout.

In some examples of the twelfth or thirteenth aspects, the pour spout includes a hollow body defining a central bore, and a filter residing in the bore, the filter configured to inhibit the dispensing of non-fluid particles from the bottle assembly. In some examples, the pour spout is directly attachable to a portion of the bottle severing mechanism.

In some examples of the twelfth or thirteenth aspects, the bottle severing mechanism includes an articulated linkage for constraining movement of the top portion of the bottle. In some examples, the linkage includes at least two linkage members coupled by a hinge joint remote from both the bottle and a closure member received by a top opening of the bottle, the linkage configured to facilitate rotational pitch movement of the severed top portion of the bottle relative to the body, while preventing rotational roll and yaw movement of the top portion. In some examples, the linkage includes: a lever member pivotally coupled to the bottle; and a retainer member having a first end directly attached to a closure member received by a top opening of the bottle, and a second end attached to the lever member by a hinge joint. In some examples, the hinge joint includes a uniaxial connection between the lever and retainer members permitting relative rotational movement in only one degree of freedom. In some examples, the linkage permits rotational movement of the severed top portion with multiple degrees of freedom in only a single plane.

In some examples of the twelfth or thirteenth aspects, the bottle assembly further includes a muselet for retaining a closure member residing in a top opening of the bottle, the muselet at least partially covering a portion of the closure member and extending no further than a region of the bottle between the top opening and an annular flange proximate the neck of the bottle, such that a lower surface of the annular flange remains exposed for impact by the striking edge.

In some examples of the twelfth or thirteenth aspects, the bottle severing mechanism includes a bottle striker. In some examples, the bottle striker includes: a frame mounted to move relative to the bottle in response to the sabering strike while remaining coupled to the bottle; and a striking edge extending from the frame and aligned with a lower surface of an annular flange of the bottle, such that movement of the frame relative to the bottle causes the striking edge to strike a lower surface of the annular flange to sever the top portion of the bottle from the body. In some examples, the frame is seated on a guide member extending radially outward from the bottle, and configured to ride along the guide member, such that movement of the frame induced by the sabering strike is guided in an upward direction relative to the annular flange. In some examples, the bottle striker further includes a base plate held fixed against a lower surface of the frame, and the guide member is encased within interior cavities of the frame and base plate.

In some examples of the twelfth or thirteenth aspects, the bottle assembly further includes a retention member coupled to the bottle and extending over the closure and top opening of the bottle prior to the sabering strike. In some examples, the retention member includes a flexible mesh attached to the neck of the bottle. In some examples, the retention member further includes a safety mechanism including a key ring configured to receive a portion of the user's hand while gripping the bottle during the sabering strike.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings may indicate like elements.

DETAILED DESCRIPTION

Figure 1A:
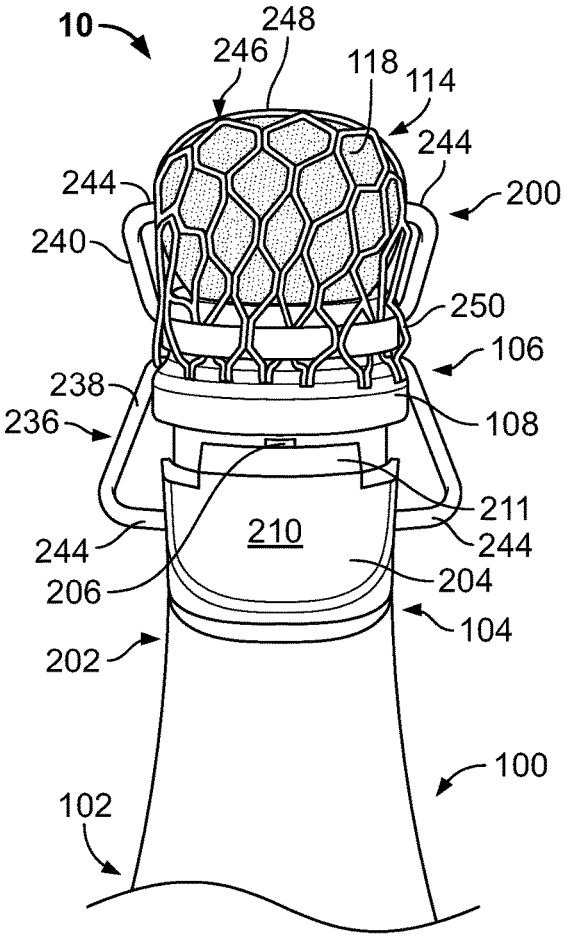
FIGS. 1A and 1B are front and side views of a portion of a bottle assembly in accordance with one or more embodiments of the present disclosure.
Figure 1B:
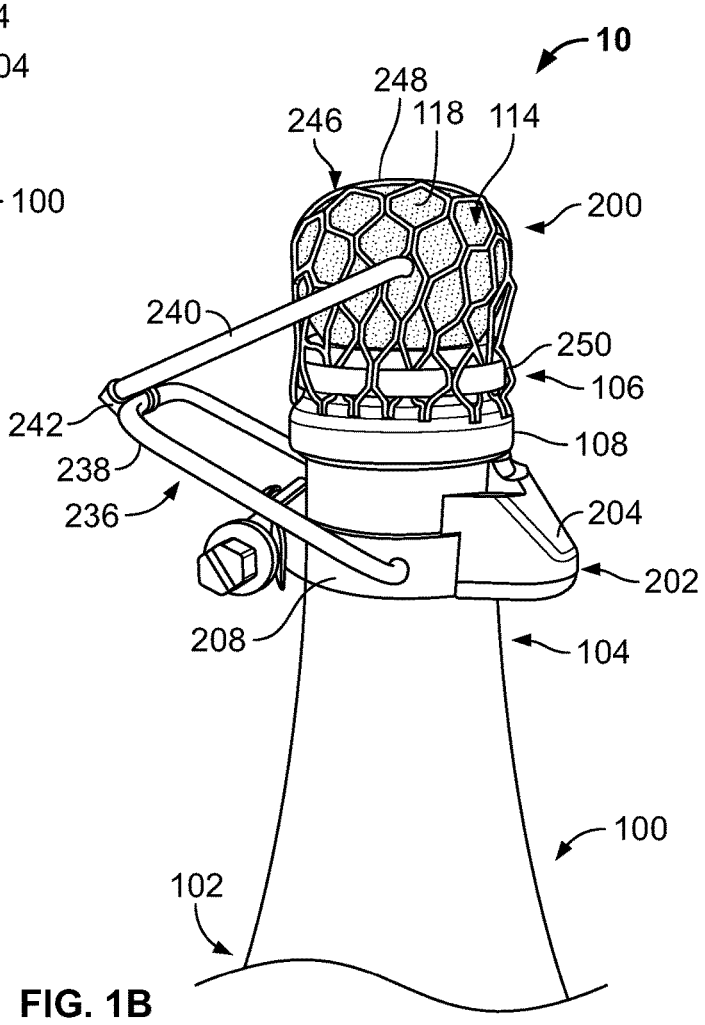
Figure 1C:
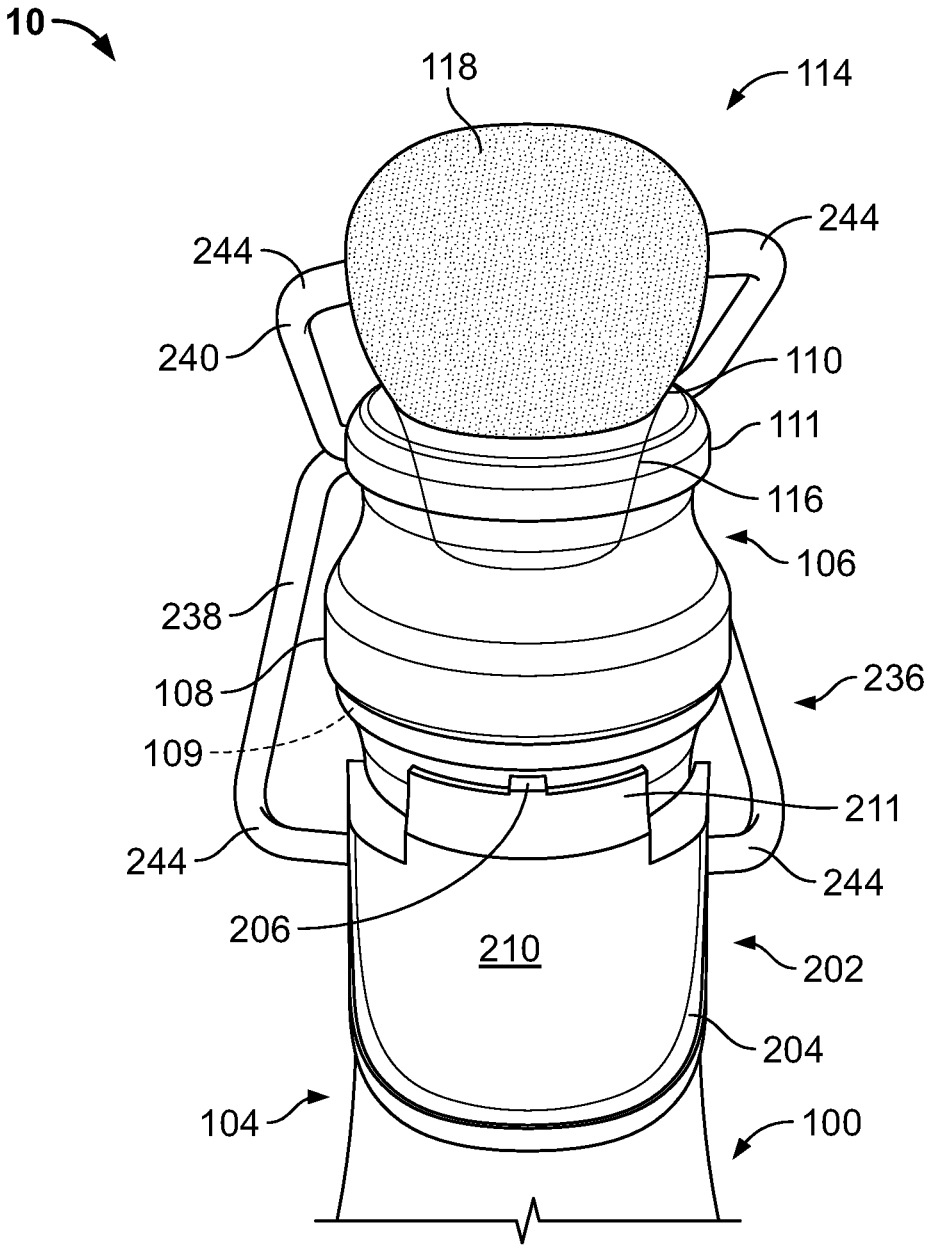
FIG. 1C is front view of the bottle assembly of FIGS. 1A and 1B with the muselet removed.

Referring first to FIGS. 1A-1C, a bottle assembly 10 features a pressurized bottle 100 and a bottle severing mechanism 200 installed on the bottle 100. The interior cavity of the bottle 100 may contain any fluid safely held under pressure. In many examples, the fluid is a pressurized consumable distilled beverage (e.g., champagne). However, various other types of pressurizable fluids are also envisioned. The bottle 100 includes an elongated body 102 extending from a lower region (not shown, but which may include a base surface often called a "heel" and an indentation on the underside of the heel often called a "punt") to an inwardly sloping shoulder region. The shoulder region of the body 102 transitions to a relatively slender neck 104. The neck 104 extends upward integrally from the shoulder region of the body 102 to a top portion 106 of the bottle 100. The top portion 106 includes an annular flange 108 having an exposed lower surface 109 and an opening 110 defined by an outer rim 111 (see FIG. 1C). The top opening 110 engages a closure member 114—a standard cork in the example—having a cylindrical first portion 116 (shown in hidden lines in FIG. 1C) received by the opening 110 to extend within the interior cavity of the bottle, and a bulbous second portion 118 (integrally formed with the first portion) that resides beyond the interior bottle cavity and extends above the opening 110 (see FIG. 1C).

The bottle severing mechanism 200 is located near the top portion 106 of the bottle 100, and, as described in detail below, is designed to (1) assist the user with executing a safe and reliable sabering strike; and (2) constrain movement of the severed portion of the bottle after sabering to prevent injury to the user and any bystanders. Note that by "saber" we refer to any structure suitable (e.g., having a certain minimum rigidity) for impacting a movable element (e.g., the frame and base plate assembly 204/218) of the bottle severing mechanism 200 with sufficient force to cause the top portion 106 of the bottle 100 to be severed from the body 102. Thus, the term "sabering strike" refers to a user wielding a suitable saber to impact the movable element of the mechanism 200 (see FIGS. 3A-3D). In some implementations, a suitable saber is provided in the form of a conventional one-edged sword, with the blunt backside of the saber being used to contact the movable element. In some implementations, the saber is formed from a plastic material or hardened steel.

In this example, the bottle severing mechanism 200 includes a bottle striker 202, an articulated linkage 236, and a muselet 246. The bottle striker 202 is carried on the neck 104 of the bottle 100, residing just below the annular flange 108 of the bottle's top portion 106. The bottle striker 202 includes a frame 204, a striking edge 206, and a clamp 208. The frame 204 is an arcuate structure having a generally convex front face 210 and a concave rear face 212 (see FIG. 2C) matching the curve of the bottle 100. As discussed in detail below, the frame 204 is supported by the clamp 208, which is provided as a screw-tightened collar fastened around the outer surface of the neck 104, and mounted to move relative to the bottle 100 in response to an impact by a saber (see FIGS. 3A-3D). The striking edge 206 extends integrally from the frame 204 via an upward sloping rim 211, and is located directly below the lower surface 109 of the bottle's annular flange 108. Thus, movement of the frame 204 relative to the bottle 100 causes the striking edge 206 to strike the flange lower surface 109 to sever the bottle's top portion 106 from the body 102. In some examples, the striking edge 206 is also aligned with the seam of the bottle 100, such that the striking edge 206 strikes the bottle 100 at the "weak point" where the seam meets the intersection between the annular flange 108 and the neck 104. The striking edge 206 is specifically designed to concentrate the force applied to the frame 204 by the impact of the user's saber, which improves the reliability of the sabering strike. In this example, the striking edge 206 has an upwardly sloping profile, narrowing to a straight-edge tip at its peak (see FIG. 2C). In some examples, the arc length $AL_e$ of the striking edge 206 is be about 3 mm (e.g., between about 1 and 5 mm, at least about 2 mm, and/or at most about 4 mm).

The articulated linkage 236 is provided as a safety measure designed to protect both the user and any bystanders from being injured by the severed top portion 106 of the bottle. For example, the linkage 236 protects surrounding bystanders by tethering the severed top portion 106 to the body 102 of the bottle 100, which prevents the top portion 106 from being violently shot out away from the bottle 100 at high velocity by the force of the sabering strike combined with the pressure force of the released fluid (referred to hereinafter as the "release force"). The linkage 236 also protects the user by constraining movement of the severed top portion 106 to certain limited degrees of freedom. In this particular example, the linkage 236 allows rotational pitch movement of the top portion 106, but prevents rotational roll and yaw movement.

In this example, the linkage 236 includes a lever member 238 and a retainer member 240 attached to one another by a hinge joint 242. The lever member 238 is pivotally coupled to the bottle 100 at one end, and extends outward away from the bottle 100 to meet the retainer member 240 at the hinge joint 242. Here, the lever member 238 is mounted to the collar portion of the clamp 208, which, as described above, is fastened around the bottle's neck 104. The coupling between the lever member 238 and the clamp 208 allows the lever member 238 to pivot about a stationary fulcrum point on the bottle 100 in a single degree of freedom. Of course, in other examples, the lever member 238 could be attached directly to the bottle 100. The retainer member 240 is directly attached to the bulbous second portion 118 of the closure member 114, and extends outward away from the closure member 114 to meet the lever member 238 at the hinge joint 242. In this example, the lever member 238 and the retainer member 240 are C-shaped brackets with inwardly facing prongs 244 that facilitate attachment to the clamp 208 and closure member 114, respectively. Each of the lever and retainer members 238,240 is formed from a stainless steel wire having a circular cross-section defining a diameter of about 2.5-3.0 mm (e.g., about 9-10 gauge). Of course, other implementations are also envisioned within the scope of the present disclosure. In any event, regardless of their form factor, the lever member 238 and retainer member 240 should have sufficient structural strength to withstand the release force (e.g., at least about 160 Newtons).

Figure 3A:
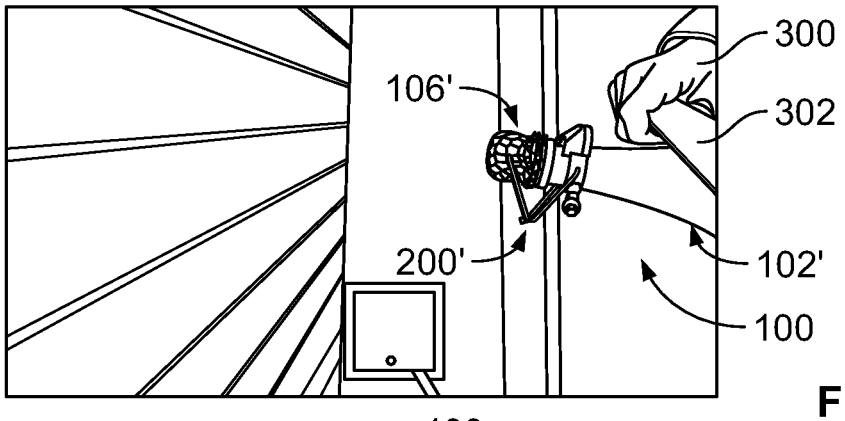
FIGS. 3A-3D are progressive views illustrating a bottle-sabering technique using the bottle assembly of FIGS. 1A and 1B.
Figure 3B:
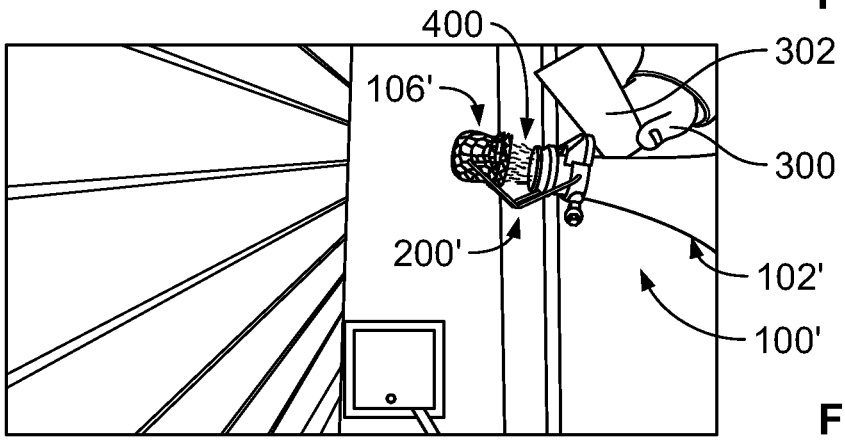
Figure 3C:
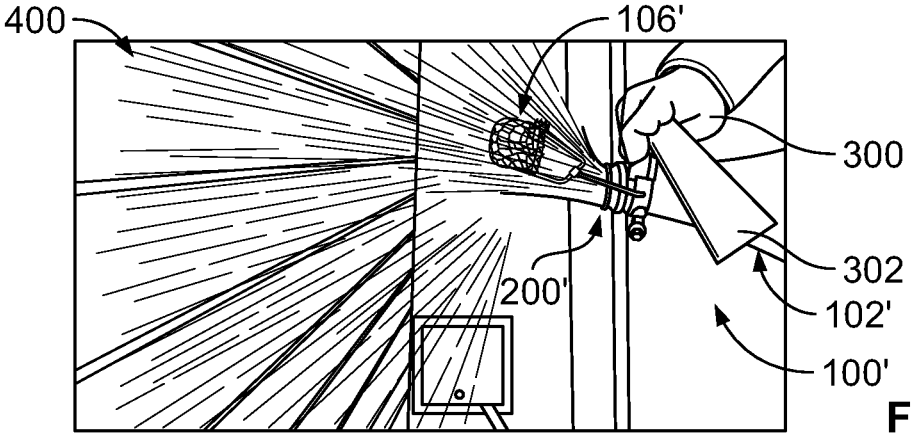
Figure 3D:
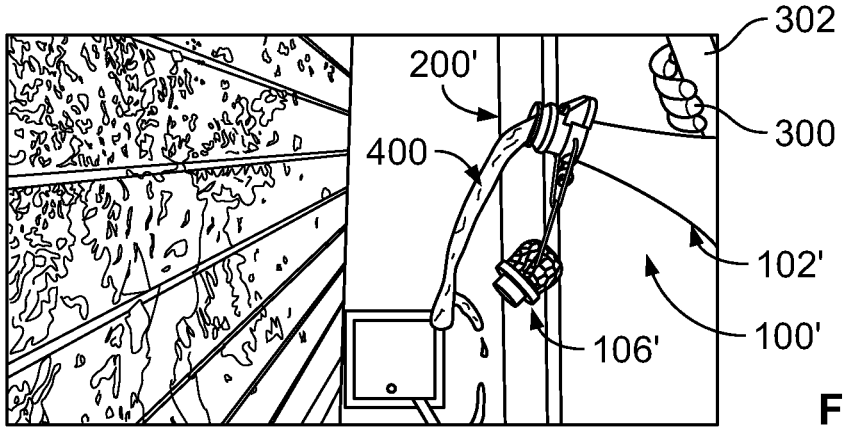

As noted above, the lever member 238 and the retainer member 240 extend outward from the bottle 100 to meet at the hinge joint 242. Thus, the hinge joint 242 is spaced apart (i.e., "remote") from the bottle 100, and the lever and retainer members 238,240 are posed at an acute angle relative to one another, forming a sideways V-shaped structure. The hinge joint 242 allows the lever member 238 and the retainer member 240 to pivot freely relative to one another about a fixed axis through the joint. The hinge joint 242 is a uniaxial coupling between the lever member 238 and the retainer member 240, and therefore allows movement between the two members in only a single plane, which corresponds to rotational pitching. This design allows the linkage 236 to expand (i.e., straighten out, as shown in FIG. 3C) along the direction of sabering, which permits the severed top portion 106 to separate from the neck 104 and body 102 after sabering. Notably, the relative rotational pitching permitted by the joint 242 is the same type of movement permitted by the coupling of the lever member 238 to the clamp 208.

Because the lever member 238 is coupled to the body 102 of the bottle 100 and the retainer member is directly attached to the closure member 114, when the bottle's top portion 106 is severed from the body 102 by a sabering strike, the linkage 236 facilitates rotational pitch movement of the top portion 106 relative to the body 102, while preventing rotational roll and yaw movement. Thus, after the sabering strike, the linkage 236 functions as a planar two-bar linkage with two degrees of freedom in the rotational pitch direction. Constructing the linkage 236 with multiple degrees of freedom in the rotational pitch direction increases the amount of mechanical energy dissipated as the severed top portion 106 of the bottle 100 swings upward and outward from the body 102. This characteristic of the linkage 236 is advantageous because it reduces the likelihood that the severed top portion 106 will hit the backside of the body 102 with significant force and rebound back towards the user's hands (see FIGS. 3A-3D). Instead, we have found that the severed top portion 106, which is expelled from the body as high velocity projectile, merely straightens out the linkage 236 and falls downward harmlessly in an arc under the force of gravity.

As noted above, the bottle severing mechanism 200 further includes a muselet 246 for retaining the closure member 114 in place relative to the bottle 100 prior to sabering. More specifically, the muselet 246 is provided to prevent the closure member 114 from being discharged from the bottle 100 by the pressurized fluid. The muselet 246 of the present disclosure generally provides the same function as the traditional design, but is modified to cooperate with the bottle striker 202. Traditional muselets are designed to cover the cork and extend down over the rim 111 of the top opening 110 to a point beyond the annular flange 108. The bottom wire of the traditional muselet is tightened in place around the neck 104 of the bottle 100 just below the flange's lower surface 109, so as to clamp down on the cork. This configuration is problematic for proper functioning of the bottle striker 202, because it shields the lower surface 109 of the flange 108, which is the desired point of impact for a sabering strike. Thus, the illustrated muselet extends down only so far as to the region of the bottle between the rim 111 of the top opening 110 and the annular flange 108. As such, the flange's lower surface 109 remains exposed for sabering the top portion 106 of the bottle 100 from the body 102 without striking the muselet 246. This characteristic of the muselet 246 is advantageous because it allows the user to perform the sabering strike without first removing the muselet 246 holding the closure member 114 in place. Thus, the safety of the sabering experience is increased, as any risk of the closure member 114 being prematurely discharged from the bottle 100 by fluid pressure is mitigated.

In this particular example, the muselet 246 includes a fishnet 248 covering the bulbous second portion 118 of the closure member 114 and a tightened band 250 fitted over the fishnet 248 in the region between the rim 111 and the annular flange 108. The fishnet 248 is a light-weight flexible lattice structure draped over the closure member 114. The band 250 may be a plastic tie-wrap or a metal wire. Of course, various other implementations may involve different configurations of the muselet 246 using different materials and/or form factors. For instance, in one example, the muselet 246 may include a wire cage.

Figure 2A:
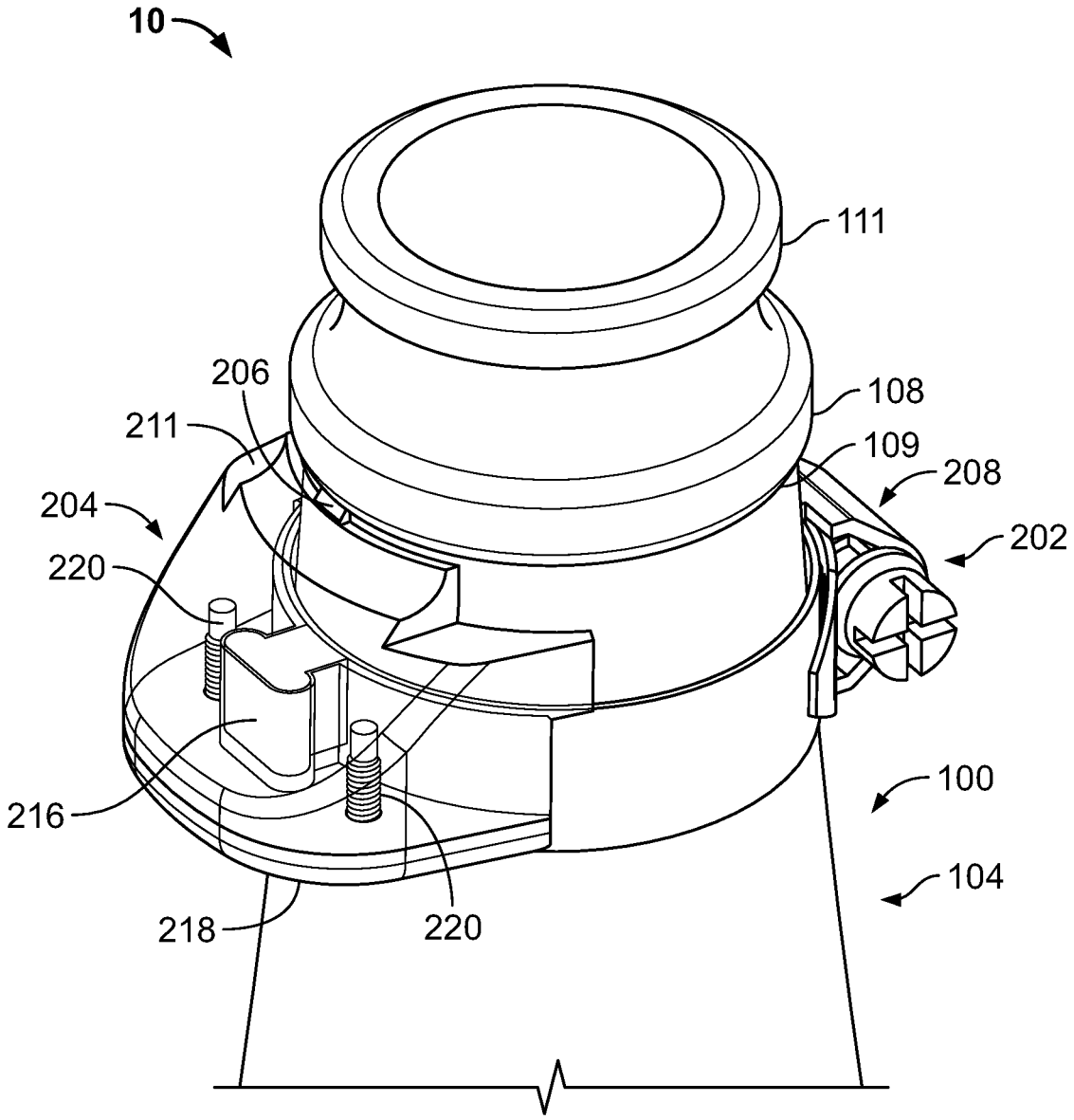
FIG. 2A is a perspective view of a bottle striker installed on a pressurized bottle of fluid.
Figure 2B:
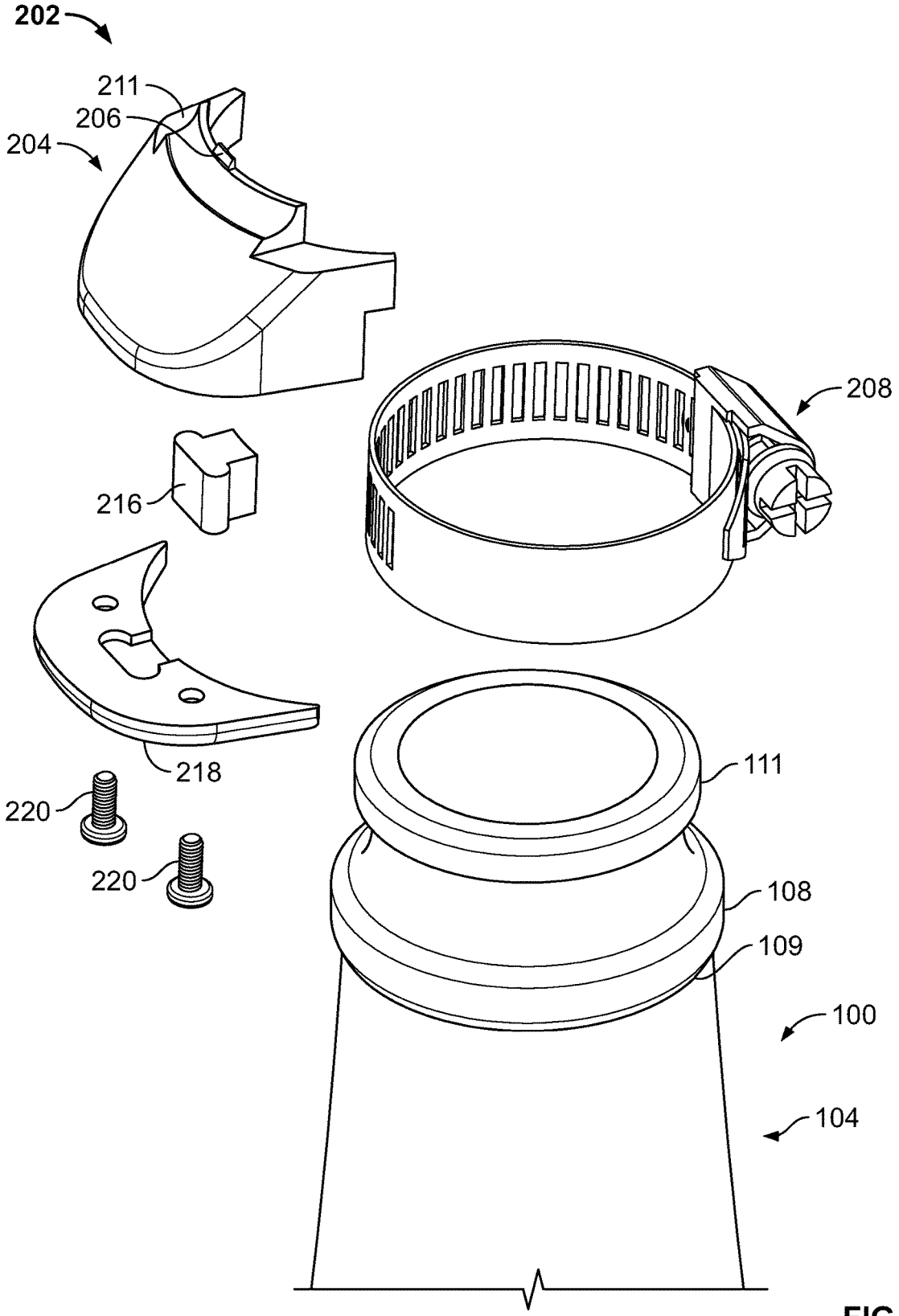
FIG. 2B is an exploded perspective view of the bottle striker of FIG. 2A.
Figure 2C:
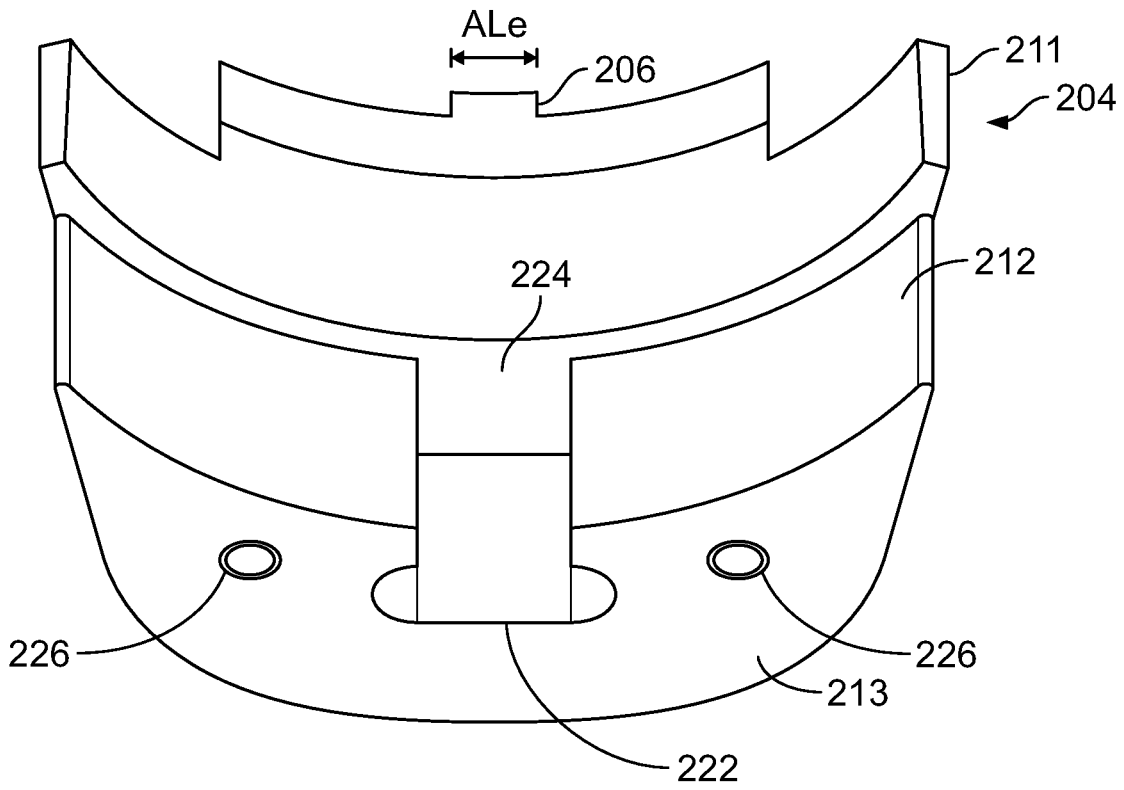
FIG. 2C is a perspective rear view of a frame of the bottle striker of FIG. 2A.

FIGS. 2A-2D provide detailed illustrations of various portions of the bottle striker 202. As noted above, the frame 204 (shown transparently in FIG. 2A) is mounted on the clamp 208 to move relative to the bottle 100 in response to an impact by a saber. In this example, the bottle striker 202 further includes a mounting sub-assembly featuring a T-nut 216, a base plate 218, and mounting screws 220. The T-nut 216 is directly attached to the clamp 208, and therefore held in a fixed position relative to the bottle 100. As shown, the T-nut extends radially outward from the bottle 100, providing a seat for the frame 204. The frame 204 is designed to ride along the T-nut 216, such that motion of the frame 204 induced by the impact of a saber is guided in an upward direction for a limited distance to force the striking edge 206 against the flange lower surface 109. To enable this functionality, the frame 204 includes a slot 222 and an upper shelf 224, as shown in FIG. 2C. The slot 222 is appropriately shaped to receive the T-nut 216, and is open to the rear face 212 and a flat lower surface 213 of the frame 204. The upper shelf 224 closes the top end of the slot 222. The frame 204 further includes a set of threaded screw holes 226 open to the lower surface 213 for receiving the mounting screws 220 used to secure the base plate 218 to the frame 204.

Figure 2D:
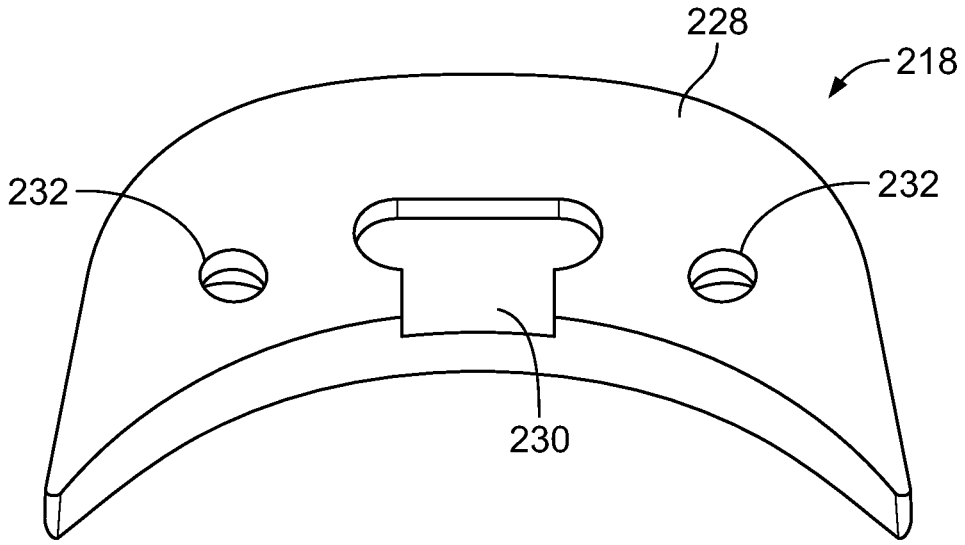
FIG. 2D is a perspective rear view of a base plate of the bottle striker of FIG. 2A.

The base plate 218 is provided to lock the frame 204 onto the T-nut 216. The outline shape of the base plate 218 closely resembles that of the frame's lower surface 213, and the plate's upper surface 228 is flat. Thus, the base plate 218 fits substantially flush against the frame 204, as shown in FIG. 2A. FIG. 2D shows that the base plate 218 includes a recess 230 shaped to accommodate and receive the T-nut 216, and a set of threaded screw holes 232 for receiving the mounting screws 220. The depth of the recess 230 may be about 1 mm (e.g., between about 0.3 and 1.5 mm, at least about 0.5 mm, and/or at most about 1.7 mm). The recess 230 and screw holes 232 are located on the base plate 218, such that they align with the slot 222 and screw holes 226 of the frame 204, respectively.

The bottle striker 202 is assembled on the bottle 100 by, first, fastening the clamp 208 around the bottle's neck 104 to fix the T-nut 216 in place. Next, the frame 204 is aligned with the clamp 208, such that the opening of the slot 222 at the frame's lower surface 213 is located directly above the stationary T-nut 216. The frame 204 is then seated on the T-nut 216. That is, the frame 204 is slid down over the T-nut 216 via the slot 222 until the upper shelf 224 abuts the top of the T-nut 216. The base plate 218 is then aligned with, placed flush against, and secured to the lower surface 213 of the frame 204. The mounting screws 220 extend through the screw holes 226,232 of both the base plate 218 and the frame 204 to effectively clamp the two structures against one another. Once secured by the mounting screws 220, the base plate 218 and the frame 204 completely encase the T-nut 216 within the slot 222 and recess 230. The depth of the recess 230 creates a gap between the lower surface of the T-nut 216 and the base plate 218. The upward movement of the frame 204 relative to the bottle 100 is limited by the vertical extent of the gap. That is, when a user strikes the bottom surface 234 of the base plate 218 with a saber, the force of the strike is transferred from the base plate 218 to the attached frame 204, causing the frame 204 and base plate 218 to ride upward along the stationary T-nut 216 until the floor of the recess 230 abuts the bottom of the T-nut 216. This limited upward movement is sufficient to thrust the striking edge 206 against the lower surface 109 of the bottle's annular flange 108. Further, because the T-nut 216 is encased by the slot 222 and recess 230 of the frame 204 and base plate 218, these components remain attached to the clamp 208, and therefore coupled to the bottle 100. Thus, the bottle striker 202 is specifically designed to provide a movable force-transferring component for facilitating a precisely located sabering blow that remains safely and securely coupled to the bottle 100 in order to lessen the risk of injury. Further still, because the depth of the recess 230 enables relative movement of the frame 204 by only a short upward distance, the energy loss in the force transfer from the user's saber is mitigated.

FIGS. 3A-3D illustrate various stages of a sabering method of severing the top portion 106' from the body 102' of a bottle 100' using a bottle severing mechanism 200'. Various elements of the bottle 100' and the severing mechanism 200' are similar (if not identical) to those described above with reference to FIGS. 1A-2D. As shown, this exemplary sabering technique is performed by a user 300 sliding a saber 302 along the neck of the bottle 100' into contact with the base plate of the severing mechanism 200'. As discussed above, force applied to the base plate by the impact of the saber 302 is transferred to the frame movably mounted to the clamp secured in place around the bottle's neck. Movement of the frame causes the striking edge to be thrust "upward" into the lower surface of the bottle's annular flange, creating a rapidly propagating crack that severs the top portion 106' of the bottle 100' from the body 102'. Pressurized fluid 400 released from the bottle 100' combined with the force of the sabering strike forcibly pushes the severed top portion 106' outward. As discussed above, the linkage assembly of the bottle severing mechanism 200' constrains movement of the severed top portion 106' to the rotational pitch direction and simultaneously dissipates mechanical energy to retard motion of the projectile severed top.

Figure 4A:
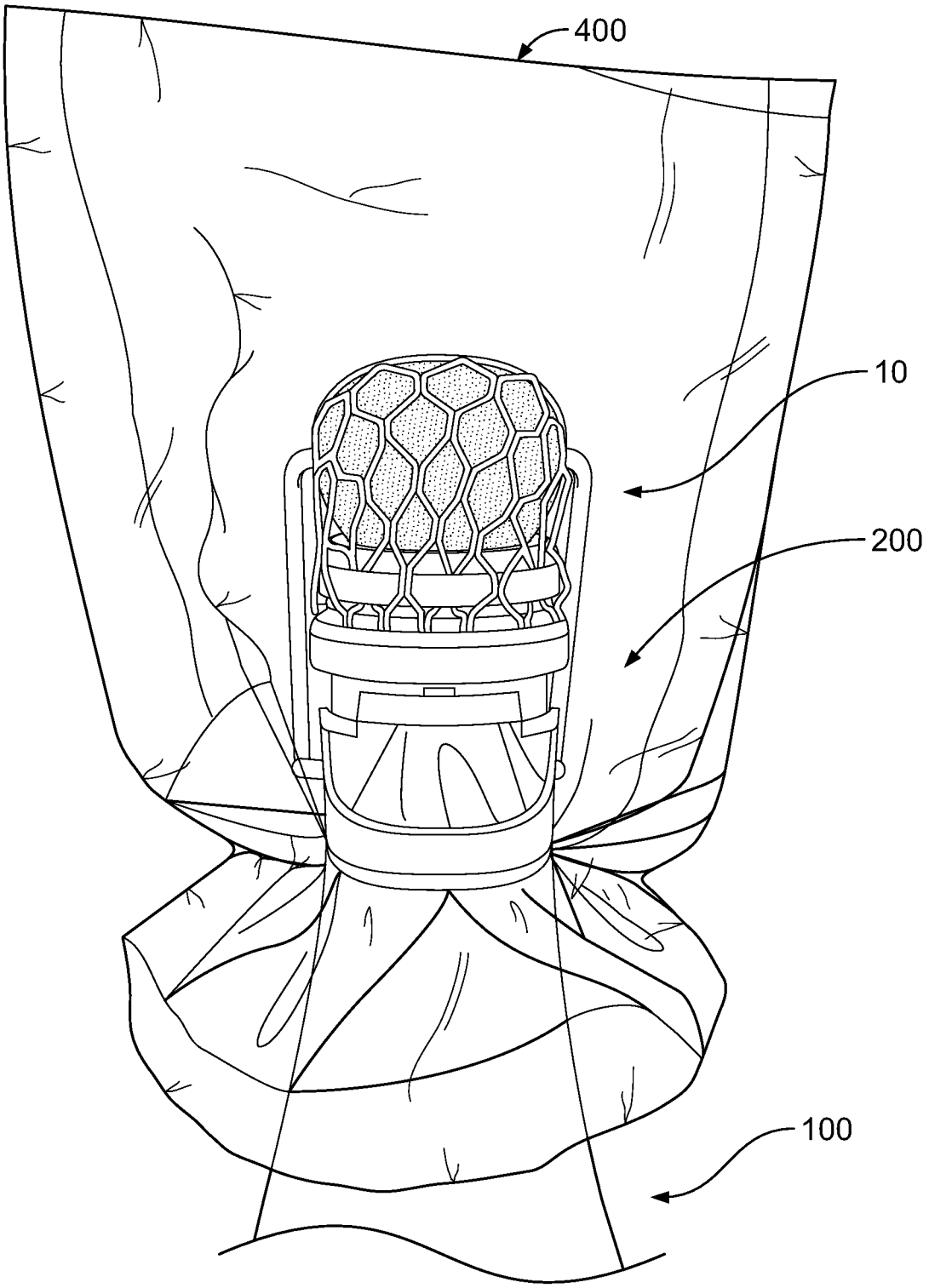
FIG. 4A is a front view of the bottle assembly of FIGS. 1A and 1B carrying a first example retention member.

FIG. 4A illustrates the bottle assembly 10 further equipped with a first example retention member 400. As shown, the retention member 400 is coupled to the bottle 100 (e.g., directly attached to a portion of the bottle 100 or bottle severing mechanism 200), and extends over and around the bottle's top portion, including the bottle severing mechanism 200 and the bottle's closure member. The retention member 400 is configured to retain to a confined space any solid particles (e.g., small pieces of glass, cork material, and the like) that may be projected outward from the bottle 100 during the sabering process (see FIGS. 3A-3D). Unlike solid particles, the retention member 400 allows discharged fluid to pass through relatively uninhibited. In this example, the retention member is provided in the form of a flexible fabric mesh attached (e.g., cinched or tied with a drawstring) to the neck of the bottle 100. Of course other suitable configurations for retaining solid particles are also contemplated within the scope of this disclosure.

Figure 4B:
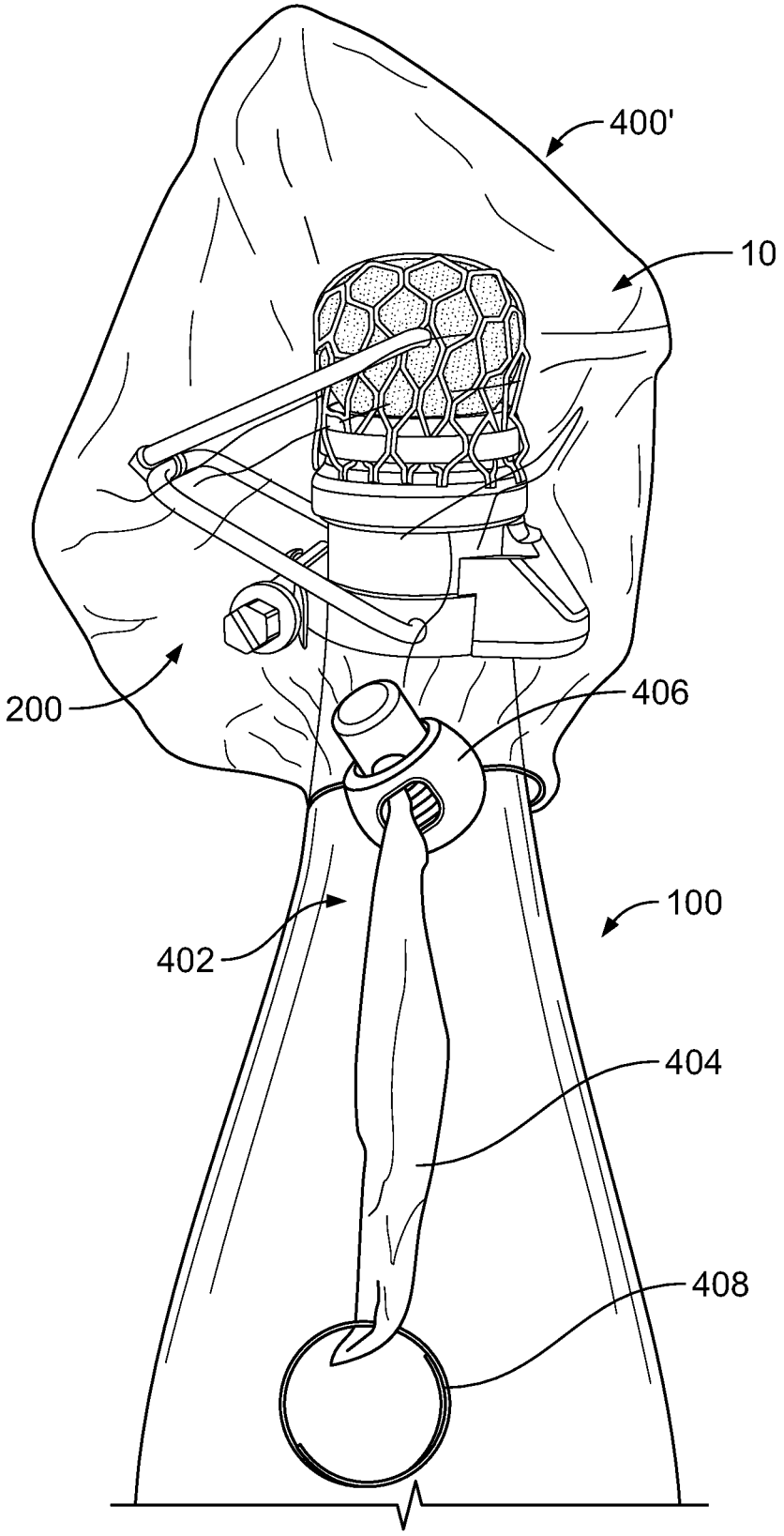
FIG. 4B is a side view of the bottle assembly of FIGS. 1A and 1B carrying a second example retention member.

FIG. 4B illustrates the bottle assembly 10 equipped with a second example retention member 400'. Like the prior example, the retention member 400' is coupled to the bottle 100, and provided in the form of a flexible fabric mesh configured to retain to a confined space any solid particles that may be projected outward from the bottle 100 during the sabering process. However, in this example, the retention member 400' further includes a safety mechanism 402 designed to ensure that the portions of the bottle assembly 10 covered by the retention member 400' are not forcibly discharged as a result of sabering.

In this example, the safety mechanism 402 includes a drawstring 404, a spring-loaded cord clamp 406, and a key ring 408. As shown, the drawstring 404 and cord clamp 406 are used to cinch the retention member 400' about the neck of the bottle 100 just below the clamp of the bottle severing mechanism (see elements 200, 208 of FIG. 1A). Under normal conditions, the drawstring 404 held by the cord clamp 406 is sufficient to retain the retention member 400' in place on the bottle 100. However, in the extraordinary case where the clamp of the bottle severing mechanism fails and becomes detached from the bottle 100, the cinched drawstring 404 can be rendered ineffective. The key ring 408 is provided as an additional measure of safety to address this clamp-failure scenario. To implement the additional safety measure, the user loops the key ring 408 over a finger gripping the lower body of the bottle 100 during the sabering strike. In this way, even if the clamp holding the bottle severing mechanism in place fails, the retention member 400' and all covered components are restrained by the user's finger via the key ring 408. Thus, no solid objects decoupled from the bottle 100 during sabering are discharged in an unrestrained manner.

Figure 5A:
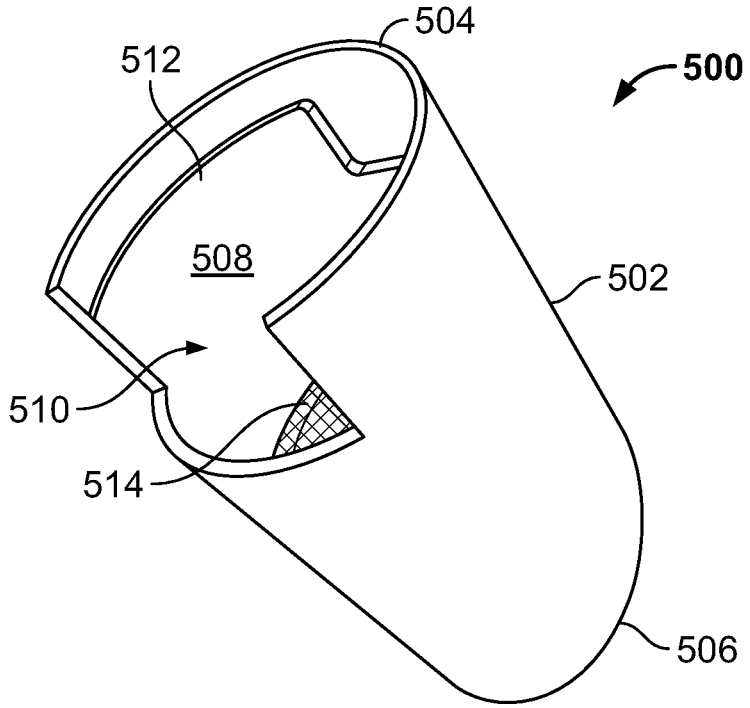
FIGS. 5A and 5B are perspective and bottom views of a pour spout in accordance with one or more embodiments of the present disclosure.
Figure 5B:
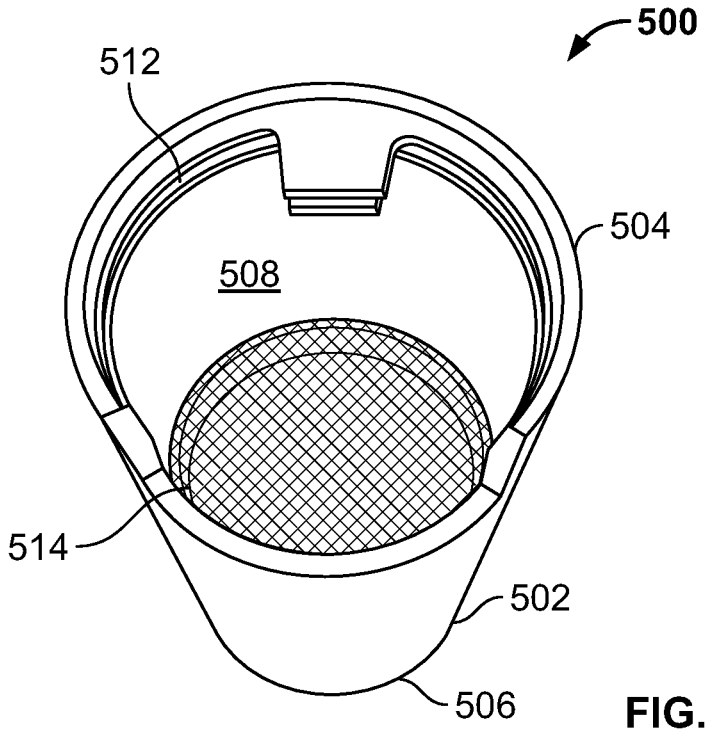
Figure 6A:
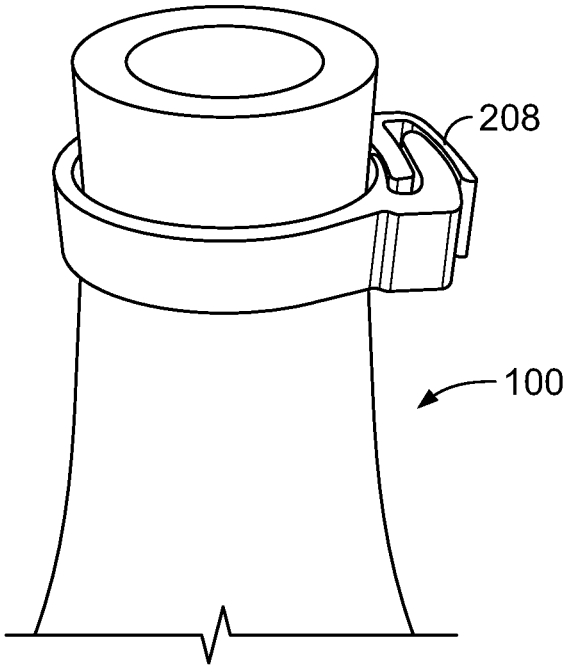
FIGS. 6A and 6B are progressive side views demonstrating installation of the pour spout of FIGS. 5A and 5B onto a bottle assembly following a sabering strike.
Figure 6B:
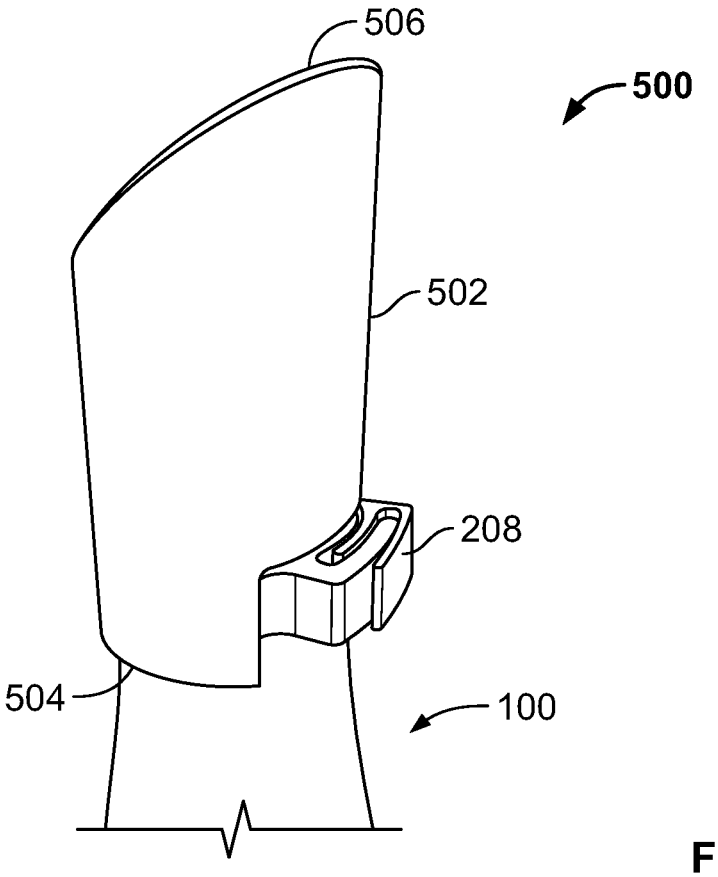

FIGS. 5A-6B illustrate a pour spout 500 that can be used in conjunction with the bottle assembly 10. The pour spout 500 provides the dual function of (1) facilitating the controlled dispensing of fluid from the bottle 100 once sabered, and (2) filtering any solid (i.e., non-fluid) particles that may have been introduced to the bottle's contents during the sabering process. As shown in FIGS. 5A and 5B, the pour spout 500 includes a hollow, tubular body 502 extending from an open bottom end 504 to an open top end 506. The tubular body 502 defines a central bore 508. FIGS. 6A and 6B demonstrate how the pour spout 500 is coupled to the bottle 100, covering an exposed portion of the neck following a sabering strike removing the bottle's top portion 106 (see FIGS. 1A and 1B).

The side wall of the tubular body 502 has a cutout portion 510 extending upward from the bottom end 504 of the tubular body 502 through a relatively short portion of the overall height of the spout 500. This cutout portion 510 is designed to accommodate portions of the bottle severing mechanism 200 that remain attached to the bottle 100 after sabering (e.g., the clamp 208 tightened around the neck of the bottle 100, as shown in FIG. 6B). The side wall of the tubular body 502 at the top end 506 is upwardly sloped to aid in channeling the fluid contents dispensed from the bottle 100. The inner wall of the central bore 508 proximate the bottom end 504 of the tubular body 502 features a pattern of inwardly facing protrusions 512. The protrusions 512 (see FIGS. 5A and 5B) are configured (e.g., appropriately sized and/or shaped) to engage (e.g., via friction or snap fitting) with the outer surface of the clamp 208 mounted on the sabered bottle 100 (see FIG. 6B) to hold and secure the pour spout 500 in place on the bottle 100. The pour spout 500 still further includes a filter 514 mounted within the bore 508 between the top and bottom ends 504,506 that inhibits or prevents the discharge of solid particles as fluid is dispensed from the bottle 100.

The use of terminology such as "front," "rear," "top," "bottom," "lower," "upper," and "upward" throughout the specification and claims is for describing the relative positions of various components of the bottle assembly and other elements described herein. Similarly, the use of any horizontal or vertical terms to describe elements is for describing relative orientations of the various components of the bottle assembly and other elements described herein. Unless otherwise stated explicitly, the use of such terminology does not imply a particular position or orientation of the bottle assembly or any other components relative to the direction of the Earth gravitational force, or the Earth ground surface, or other particular position or orientation that the system other elements may be placed in during operation, manufacturing, and transportation.

A number of embodiments of the invention have been described. Nevertheless, it will be understood that various modifications may be made without departing from the spirit and scope of the inventions.

What is claimed is:

1. A bottle system, comprising:

a pressurized bottle of fluid having an elongated body and a neck extending contiguously from the body to a top portion comprising an outwardly projecting annular flange, an opening, and a closure received by the opening;

a bottle severing mechanism comprising:

a collar mounted on and enclosing an outer surface of the neck of the bottle;

a bottle striker supported on the bottle by the collar and configured to move relative to the bottle, the bottle striker residing below the top portion of the bottle, and the bottle striker comprising a striking edge aligned with a lower surface of the annular flange of the bottle; and an articulated link comprising a first end connected to the collar and a second end coupled to the top portion of the bottle, wherein the articulated link is configured to facilitate rotational pitch movement of the severed top portion of the bottle relative to the body, while preventing rotational roll and yaw movement of the top portion;

a saber configured to strike the bottle striker to sever the top portion of the bottle; and a retention member comprising a mesh at least partially defining an enclosed area surrounding the top portion of the bottle, the mesh configured to permit a discharge of fluid from the enclosed area while retaining non-fluid particles within the enclosed area.

2. The bottle system of claim 1, wherein the mesh comprises a flexible fabric.

3. The bottle system of claim 2, wherein the enclosed area further surrounds the bottle striker.

4. The bottle system of claim 3, wherein the retention member is directly attached to the neck of the bottle.

5. The bottle system of claim 4, wherein the retention member further comprises a safety mechanism including a key ring configured to receive a portion of a hand of a user while gripping the bottle during a sabering strike.

6. The bottle system of claim 1, wherein the bottle severing mechanism further comprises a frame coupled to the neck of the bottle by the collar, the frame mounted to move relative to the bottle in response to an impact by a saber while remaining coupled to the bottle, and wherein the striking edge extends from the frame.

7. The bottle system of claim 6, wherein the frame comprises an arcuate structure having a concave rear face cooperating with a curve of the bottle, and wherein the frame is seated on a guide member extending radially outward from the bottle.

8. The bottle system of claim 7, wherein the frame is configured to ride along the guide member, such that movement of the frame induced by the impact of the saber is guided in an upward direction relative to the annular flange.

9. The bottle system of claim 1, wherein the striking edge is aligned with a seam of the bottle, such that a point of impact with the lower surface of the annular flange comprises a structural weak point where the seam intersects with the annular flange.

10. The bottle system of claim 9, wherein the striking edge has an upwardly sloping profile, narrowing to a straight-edge tip at a peak.

11. The bottle system of claim 1, wherein the articulated linkage constrains movement of the top portion of the bottle.

12. The bottle system of claim 1, wherein the linkage permits rotational movement of the severed top portion with multiple degrees of freedom in only a single plane.

13. The bottle system of claim 1, wherein the bottle system further comprises a muselet for retaining the closure relative to the opening of the top portion of the bottle, the muselet at least partially covering a portion of the closure and extending no further than a region of the bottle between the top opening and an annular flange proximate the neck of the bottle, such that a lower surface of the annular flange remains exposed for impact by the striking edge.

14. The bottle system of claim 1, wherein the bottle system further comprises a pour spout releasably coupled to the bottle and covering an exposed portion of the neck following a sabering strike, the pour spout configured to facilitate a controlled dispensing of fluid contained in the bottle.

15. The bottle system of claim 14, wherein the pour spout comprises a hollow body defining a central bore, and a filter residing in the bore, the filter configured to inhibit dispensing of non-fluid particles from the bottle assembly system.

16. The bottle system of claim 15, wherein the pour spout is directly attachable to a portion of the bottle severing mechanism.

17. A method of opening a pressurized bottle of fluid, the method comprising:

holding a bottle assembly in a substantially fixed position, the bottle assembly comprising:

a pressurized bottle of fluid having an elongated body and a neck extending contiguously from the body to a top portion comprising an outwardly projecting annular flange, an opening, and a closure received by the opening;

a bottle severing mechanism comprising:

a collar mounted on an outer surface of the neck of the bottle;

a bottle striker supported on the bottle by the collar and configured to move relative to the bottle, the bottle striker residing below the top portion, the bottle striker comprising a striking edge aligned with a lower surface of the annular flange of the bottle; and a link comprising a first end connected to the collar and a second end coupled to the top portion of the bottle; and a retention member comprising a mesh at least partially defining an enclosed area surrounding the top portion of the bottle, the mesh configured to permit a discharge of liquid from the enclosed area while retaining solid particles within the enclosed area; and impacting a portion of the bottle assembly with a saber with sufficient force to move the striking edge relative to the bottle and cause the striking edge to strike the lower surface of the annular flange to sever the top portion of the bottle from the body.

* * * * *